US005692923A

United States Patent [19]

Sawada

[11] Patent Number: 5,692,923

[45] Date of Patent: Dec. 2, 1997

[54] CONNECTOR ASSEMBLY

[75] Inventor: Hisashi Sawada, Yokkaichi, Japan

[73] Assignee: Sumitomo Wiring Systems, Ltd., Japan

[21] Appl. No.: 758,980

[22] Filed: Dec. 2, 1996

Related U.S. Application Data

[63] Continuation of Ser. No. 355,665, Dec. 14, 1994, abandoned.

[30] Foreign Application Priority Data

Dec. 21, 1993 [JP] Japan ..... 5-073597 U

[51] Int. Cl.[6] ..... H01R 13/73

[52] U.S. Cl. ..... 439/555; 439/350

[58] Field of Search ..... 439/350, 357, 439/550–557

[56] References Cited

U.S. PATENT DOCUMENTS 4,789,351 12/1988 Fisher, Jr. et al. ..... 439/555

5,004,430 4/1991 Delguidice et al. ..... 439/350

5,389,015 2/1995 Sasai et al. ..... 439/555

FOREIGN PATENT DOCUMENTS 32 53 62 11/1992 Japan ..... B60T 11/26

*Primary Examiner*—Khiem Nguyen

*Assistant Examiner*—Eugene G. Byrd

*Attorney, Agent, or Firm*—Jordan B. Bierman; Bierman, Muserlian and Lucas LLP

[57] ABSTRACT

This invention aims to settle an attaching state of a connector assembly by positively engaging a lock piece of the assembly with an apparatus m. In the connector assembly, a male housing 4 is provided on its side with a deformable lock piece 15, which is loosely engaged with a recess 24 formed in the apparatus m when the male housing 4 is fitted in a chamber 16 in the apparatus m. When a female housing 3 is coupled to the male housing 4, a projection 13 provided on the female housing 3 pushes the lock piece 15 from its inner side so that a pawl 15*a* is deeply engaged with the recess 24.

1 Claim, 4 Drawing Sheets

CONNECTOR ASSEMBLY

This application is a continuation of application Ser. No. 08/355,665, filed Dec. 14, 1994, now abandoned.

BACKGROUND OF THE INVENTION (1) Field of the Invention

This invention relates to a connector assembly and more particularly to a connector assembly which is adapted to be directly coupled to an apparatus.

(2) Statement of the Prior Art

Heretofore, a connector assembly comprises a male connector which is attached to an apparatus beforehand and a female connector which is coupled to the male connector thereafter. For convenience of explanation, an example of the above kind of conventional connector assembly will be described below by referring to FIG. 6. FIG. 6 is a longitudinal sectional view of a part of the conventional connector assembly, illustrating a coupling state of male and female connectors.

This conventional connector will be briefly explained below. An apparatus m is provided with a chamber 32 which is open at the left end in the drawing to receive a male housing 30 of a male connector 40. The chamber 32 is provided in its inner wall with a recess 33 adapted to prevent the male housing 30 from coming out of the chamber 32. The male housing 30 is provided on its outer face with a lock piece 34 adapted to detachably engage with the recess 33. The lock piece can be deformed inwardly and outwardly at its free end, which is opposed to the recess 33. When the male housing 30 is being fitted into the chamber 32, the lock piece 34 slides on the inner face of the chamber 32 while being deformed inwardly. When the fitting is finished, the lock piece 34 engages with the recess 33 under its recovery force. After the male housing 30 is thus prevented from coming out of the chamber 32 in the apparatus m, a housing 31 of a female connector 50 is coupled to the housing 30 of the male connector 40.

An electrical cable 35 connected to the female connector 50 may be pulled during a wiring work or the like after the male and female connectors 40 and 50 are interconnected. In this case, both connectors 40 and 50 should not be easily separated from each other. In order to avoid such failure, the lock piece 34 may engage with the recess 33 deeply. In other words, it is necessary to provide the lock piece 34 on its free end with a large pawl 34*a*.

However, this requires a large deflection of the lock piece upon coupling of both connectors. Consequently, an elastic force to the inner face exerted in the lock piece becomes great, thereby increasing a sliding resistance between the inner face on the chamber 32 and the pawl 34*a*. This will impede a smooth work. In the case that a great amount of deflection is set in the lock piece 34 having a short length, the lock piece 34 may be broken.

Heretofore, it has been impossible to set an amount of a locking distance between the pawl and the recess to be great on account of the above reasons. If the electrical cable 35 is pulled, the pawl 34*a* of the lock piece 34 may be broken to bring the connectors into detachment from the apparatus because only a small locking distance must bear the pulling force.

SUMMARY OF THE INVENTION

An object of the present invention is to provide a connector assembly which can settle an attaching state by a positive engagement between a lock piece of a connector and an apparatus.

In order to achieve the above object, a connector assembly of the present invention comprises: a first connector having a first housing adapted to be fitted in a receiving cavity formed in an apparatus, the first housing being provided on its outer side face with an elastically deformable lock piece adapted to be engaged with a recess formed in an inner face of said receiving cavity; and a second connector having a second housing adapted to be coupled in a receiving chamber in the first housing, the second housing being provided on its outer face with a projection adapted to push the lock piece toward the recess in the apparatus when the second housing is coupled in the first housing.

The lock piece may extend inwardly in its normal state.

When the first housing of the first connector is fitted in the receiving cavity in the apparatus, the lock piece engages loosely with the recess in the inner face of the receiving cavity. Then, when the second housing of the second connector is coupled to the first housing, the projection on the second housing pushes the lock piece toward the recess in the apparatus, thereby deeply engaging the lock piece with the recess.

In the case that the lock piece extends inwardly in its normal state, the lock piece on the first housing is deflected by a little distance when the first connector is fitted into the cavity in the apparatus. Accordingly, it is possible to carry out the coupling work by a light force.

The present invention can obtain the following effects. Detachment of the connectors can be surely prevented since the lock piece engages deeply with the recess in the apparatus. A sliding resistance becomes small and breakage of the lock piece can be avoided because a deflection amount of the lock piece becomes small when the first connector is fitted into the cavity in the apparatus.

Further, it is possible to set a coupling force between the first connector and the cavity to be small.

DETAILED DESCRIPTION OF THE PREFERRED EMBODIMENTS

Figure 1:
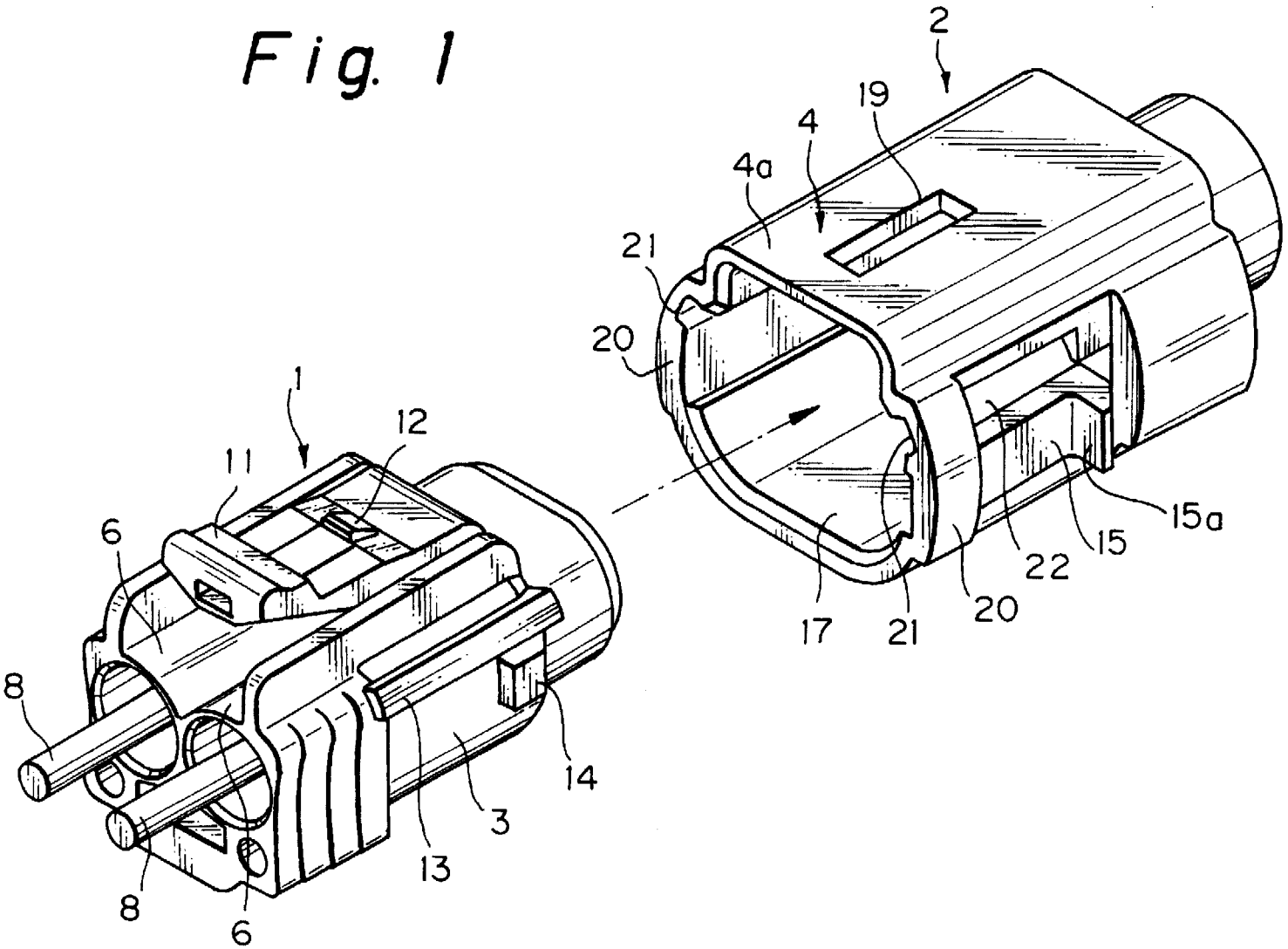
FIG. 1 is an exploded perspective view of a connector assembly of the present invention.

Embodiments of a connector assembly of the present invention will be explained below by referring to FIGS. 1 to 5. In FIG. 1, a female (second) housing 3 of a female (second) connector 1 is provided in its interior with a female terminal accommodating chamber 5 (FIG. 5), to which two cylindrical portions 6 are connected. A female terminal metal fixture 7 (FIG. 5) connected to a distal end of an electrical cable 8 is inserted into the chamber 5 through the cylindrical portion 6. A lance 9 (FIG. 5) provided in the chamber 5 engages with the associated fixture 7 to prevent it from being detached from the chamber 5. A rubber plug 10 (FIG. 5) is mounted around the electrical cable 8 at the rear side of the fixture 7 so that the plug 10 contacts sealingly with an inner face of the cylindrical portion 6. The female housing 3 is provided on its upper face with a lock arm 11 adapted to engage with a male (first) connector 2. The lock arm 11 like a cantilever extends from a front proximal end to a rear free end so as to be deflected in up and down directions. The proximal end is provided on its upper face with a lock projection 12.

The female housing 3 is provided on its opposite sides with a ridge 13. The ridge 13 extends longitudinally by a given length to serve as a guide upon coupling to a male (first) housing 4. In addition, the female housing 3 is provided on its one side and below a front end of the ridge 13 with a projection 14 (FIG. 1) which is adapted to push a lock piece 15 of the male housing 4, as described hereinafter.

Figure 4:
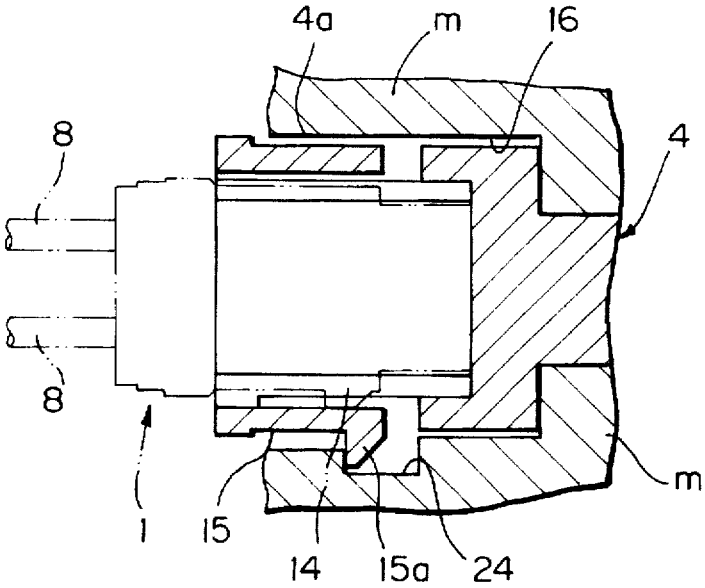
FIG. 4 is a schematic longitudinal sectional view of the connector assembly, illustrating an engaging state of the male connector and an apparatus.
Figure 5:
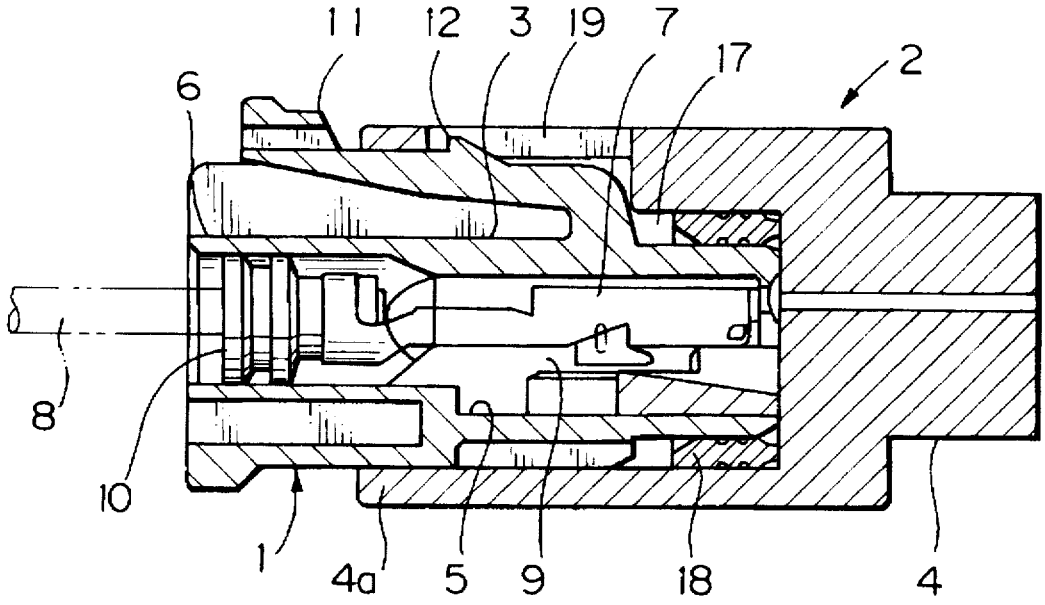
FIG. 5 is a longitudinal sectional view of the connector assembly, illustrating a coupling state of both connectors from which the apparatus is removed.
Figure 6:
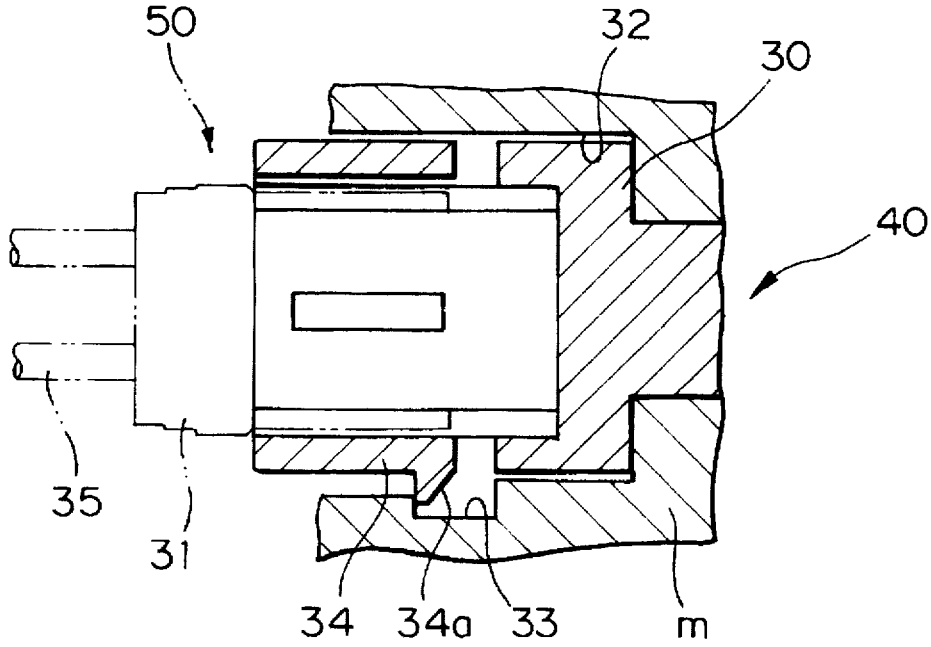
Fig. 6 PRIOR ART
FIG. 6 is a longitudinal sectional view of a conventional connector assembly, illustrating an attaching state of the assembly.

As shown in FIG. 5, the male (first) housing 4 of the male (first) connector 2 is formed to be fitted in a receiving cavity 16 formed in an apparatus m (FIG. 4). The male housing 4 is provided on its front end portion with a cylindrical hood 4*a* adapted to receive the female housing 3. The male housing 4 is provided in its interior with a male terminal accommodating chamber 17 which receives male terminals not shown. As shown in FIG. 5, a seal packing 18 is inserted in the chamber 17 to seal a space between the housings 3 and 4. Further, an engaging aperture 19 is formed in an upper wall of the male housing 4. When both housings 3 and 4 are completely coupled to each other, the lock projection 12 on the lock arm 11 engages with the aperture 19. The male housing 4 is provided on its opposite sides with an inflated portion 20 in an interior of which a guide groove 21 is provided.

Figure 2A:
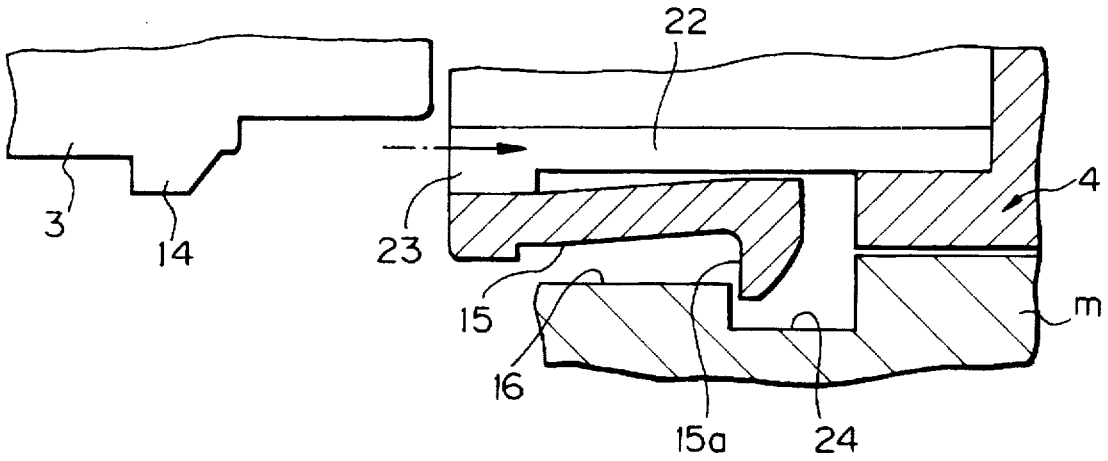
FIGS. 2A and 2B are fragmentary enlarged longitudinal sectional view of the connector assembly of the present invention, illustrating locking processes of the connector assembly.

As shown in FIGS. 2A and 1, one of the inflated portion 20 is provided on its outer face with a lock piece 15 which extends longitudinally. The inflated portion 20 which has the lock piece 15 is provided with a window 22. The lock piece 15 like a cantilever extends from an inlet proximal end adjacent to one end edge of the window 22 to a free distal end adjacent to the outer end edge of the window 22. The lock piece 15 is provided in its inlet inner face with an escape slot 23 which serves to avoid an interference with the projection.

Figure 2B:
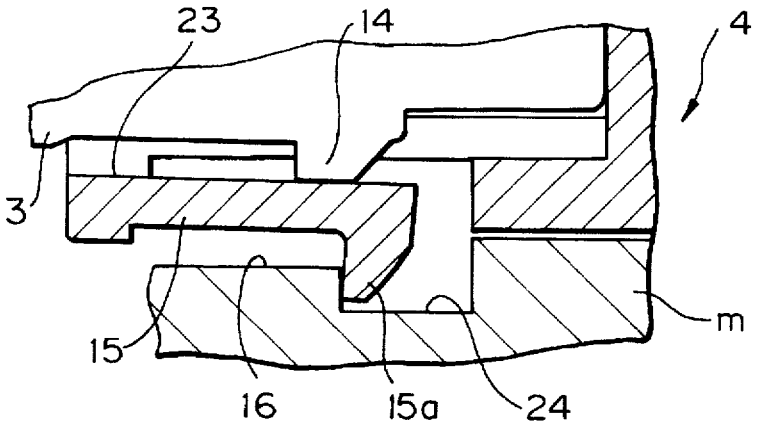
Figure 3:
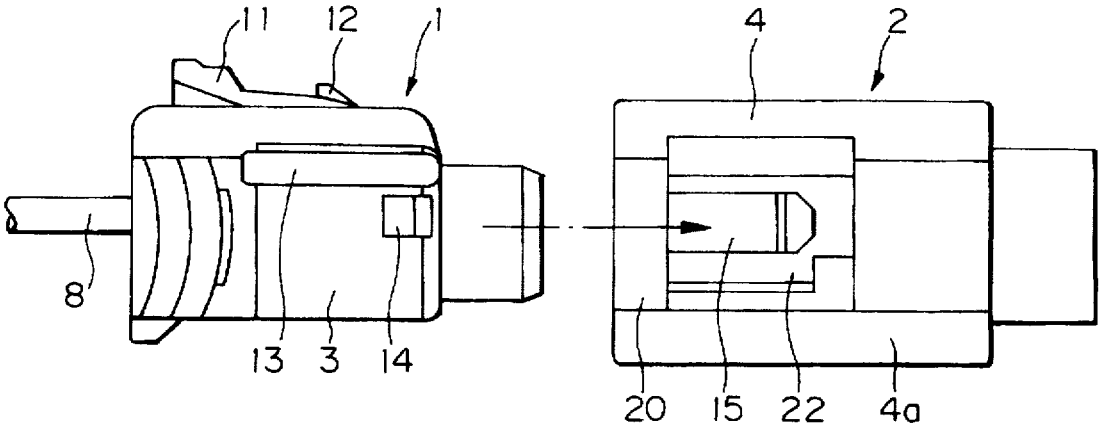
FIG. 3 is a side elevational view of male and female connectors of the connector assembly of the present invention.

As shown in FIG. 1, the lock piece 15 is provided on its outer distal end with a pawl 15*a* adapted to engage with a recess 24 (FIG. 2A) in the receiving cavity 16 in the apparatus m. Further, the lock piece 15 is gradually bent toward the window 22 at a natural state so that the pawl 15*a* loosely engages with the recess 24 when the male housing 4 is fitted in the receiving cavity 16 (FIG. 2A). In the case where the pawl 15*a* is pushed toward the recess 24 upon coupling of the female housing 3, as shown in FIG. 2B, the lock piece 15 extends straight to engage the pawl 15*a* deeply with the recess 24.

Next, an operational effect of the embodiment constructed above will be explained below. First, the male housing 4 is inserted into the receiving cavity 16 in the apparatus m through the rear side. Then, the lock piece 15 advances in the cavity 16 while the lock piece 15 is deflected toward the window 22 and is sliding on the inner face of the cavity 16. When the pawl 15*a* reaches the recess 24, the lock piece 15 returns to its original posture to loosely engage the pawl 15*a* with the recess 24 as shown in FIG. 2A. In the mean time, since the lock piece 15 is deflected inwardly (toward the window 22) as described above, an amount of deflection becomes small upon fitting. Consequently, the sliding resistance becomes low and the fitting action can be readily carried out.

After the male housing 4 has entered the cavity 16, the female connector 1 is coupled to the male connector 2. Upon coupling the female connector 1 to the male connector 2, the ridges 13 of the female housing 3 are fitted the respective guide grooves 21 in the male housing 4. When both housings 3 and 4 are completely coupled to each other, the lock projection 12 on the lock arm 11 engages with the aperture 19 in the male housing 4 to prevent the female housing 3 from coming out of the male housing 4.

On the other hand, the projection 14 slides on the inner face of the lock piece 15 through the escape slot 23 so that the lock piece 15 is gradually deformed outwardly. When the lock arm 11 is engaged with the male housing 4, the projection 14 is opposed to the pawl 15*a* on the inner face of the lock piece 15 to push the pawl 15*a* outwardly (see FIG. 2B). Thus, the lock piece 15 is forced to be straightened along the window 22 so that the pawl 15*a* engages properly with the recess 24. Accordingly, the male housing 4 is positively locked in the cavity 16 in the apparatus m.

As shown in FIG. 4, since the pawl 15*a* on the lock piece 15 can be locked in the recess 24 more deeply in comparison with the conventional lock piece, breakage of the pawl 15*a* can be avoided even if the electrical cable 8 connected to the female connector 1. The projection 14 can eliminate a clearance between the female and male housings 3 and 4, thereby cancelling plays between both housings 3 and 4.

The above embodiments can be altered within the scope of the spirit of this invention. For example, the lock piece 15 may be provided on opposite sides of the male housing 4, although the lock piece 15 is provided on one side of the housing in the above embodiment. The lock piece 15 may be arranged in compliance with a positional change of the recess 24 in the apparatus m. The female housing 3 may be fitted in the apparatus 3 instead of the male housing 4. The lock piece 15 may be provided without forming the window 22. For instance, although the lock piece 15 has the proximal end at the inlet side for the female housing 3 in the above embodiment, the lock piece 15 may have the free end at the inlet side and the projection 14 may enter a clearance between the lock piece 15 and the male housing 4 to deform the lock piece outwardly.

What is claimed is:

1. A connector assembly comprising a first connector having a first housing adapted to be fitted into a receiving cavity in an apparatus, said first housing having an outer surface with an elastically deformable lock piece mounted thereon, a recess in an inner face of said cavity adapted to receive said lock piece;

a second connector having a second housing for introduction in an insertion direction, into a receiving chamber in said first housing, said lock piece extending an angled radially inwardly in said insertion direction, a projection on an outer face of said second housing which urges said lock piece toward said recess as said second housing is moved in said insertion direction and said second housing is coupled in said first housing.

* * * * *